United States Patent [19]

Peterson

[11] 4,430,552

[45] Feb. 7, 1984

[54] THERMAL RELEASE DEVICE

[76] Inventor: David D. Peterson, 6434 Old Chesterbrook Rd., McLean, Va. 22101

[21] Appl. No.: 287,886

[22] Filed: Jul. 29, 1981

[51] Int. Cl.[3] ..... H05B 3/02

[52] U.S. Cl. ..... 219/200; 219/201; 166/54.5; 441/2; 441/33

[58] Field of Search ..... 219/200, 201; 116/107; 338/226, 232, 252, 259; 83/171; 166/54.5; 30/116; 114/221 A; 441/2, 33

[56] References Cited

U.S. PATENT DOCUMENTS

| | | | |
|---|---|---|---|
| 1,167,481 | 12/1916 | Copeland . | |
| 3,329,799 | 7/1967 | Carmody | 219/200 |
| 3,597,585 | 8/1971 | Ohno | 219/201 |
| 3,773,109 | 11/1973 | Eberline | 166/54.5 |
| 3,792,421 | 2/1974 | Frazier | 441/2 |
| 4,021,638 | 5/1977 | Asakura | 219/200 |
| 4,136,415 | 12/1979 | Blockburger | 441/2 |
| 4,208,738 | 6/1980 | Lamborn | 441/33 |

*Primary Examiner*—Roy N. Envall, Jr.
*Assistant Examiner*—Teresa J. Walberg
*Attorney, Agent, or Firm*—Arnold, White & Durkee

[57] ABSTRACT

A thermal release device made up of a heating element in contact with a thermally fusible connective link which upon supplying electric current to the heating element melts through the link and parts the linkage.

9 Claims, 4 Drawing Figures

Fig. 1
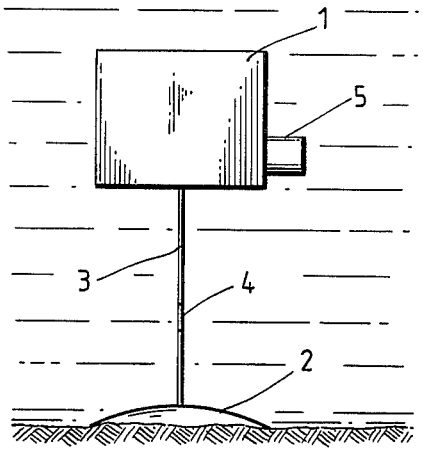
Fig. 4
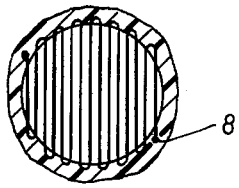
Fig. 3
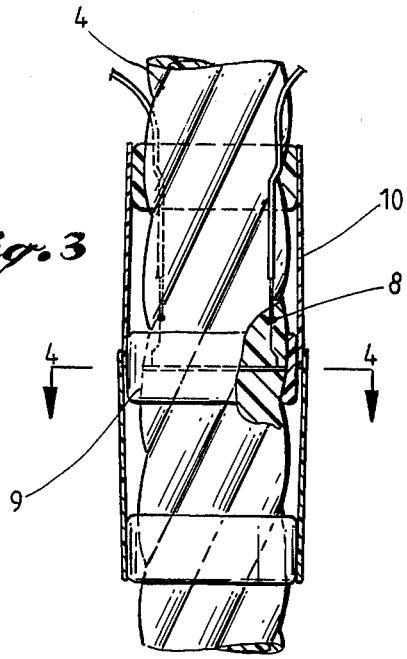
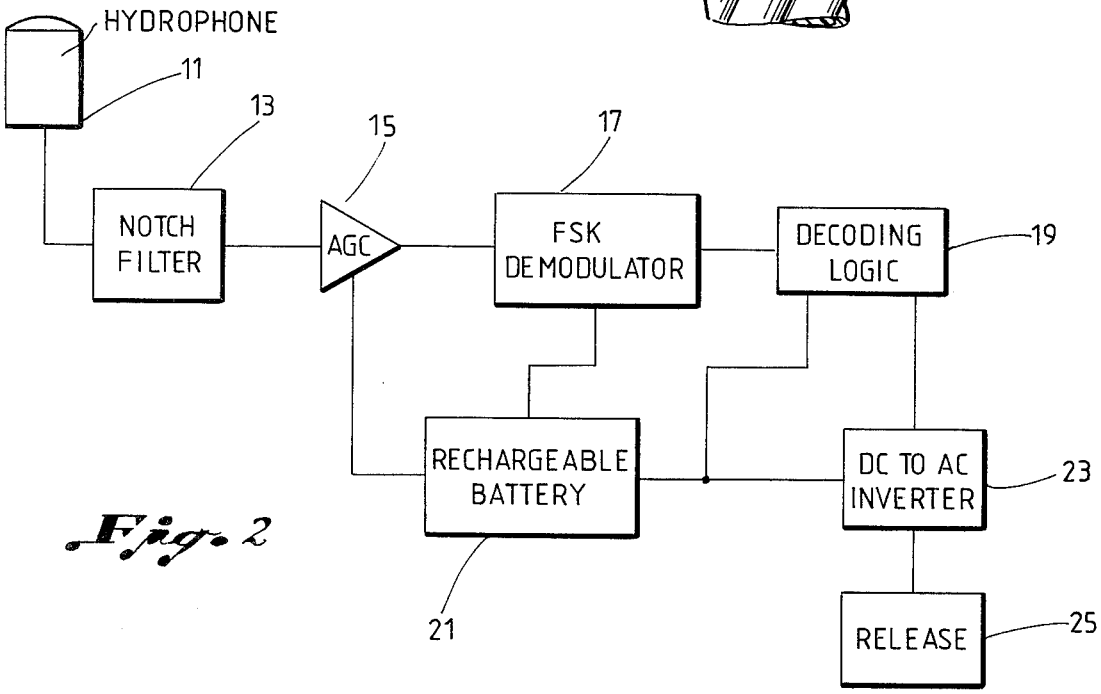
Fig. 2

THERMAL RELEASE DEVICE

BACKGROUND OF THE INVENTION

This invention relates to remotely actuated devices used to couple two units, which devices will upon command part the coupling link allowing the two units to part. More specifically, this invention is directed to a device where the release is effected by the remotely actuated melting of a segment of the connective link.

One application requiring the use of such devices is the tethering of a bouyant body in a fluid. Underwater instrumentation activities frequently require that a buoyant instrumentation package be tethered to the floor of a body of water. After the desired period of data gathering, the package is released from the tether so that it may float to the surface and be recovered. Such release devices are typically actuated by a remote acoustical signal from the recovery ship. Upon receipt of the proper coded acoustical signal, a battery powered release mechanism is actuated. Other applications requiring the separation of two coupled units upon remote command can be envisioned.

In underwater applications, the release mechanism used is frequently an explosive link. Such links do not exhibit the desired degree of reliability and have the added disadvantage of not working in the high pressure environment of deep waters. A second type of release device is the so-called electrolysis link. On this device the release link is insulated from the sea water except for a small area. The link is generally made of titanium or stainless steel. Upon receiving the remote actuation signal a current is passed through the water with this exposed area of the link as the anode. Stray current corrosion quickly corrodes the link (1–20 minutes depending up type, size). This release mechanism has the drawback that its performance is degraded by biofouling. Currently the preferred release mechanism is a mechanical release. Release devices employing a mechanical release typically use a battery powered motor to unscrew a pin, rotate a hook, or perform other similar decoupling actions. The complexity of such devices in combination with the limited market makes the mechanical release devices higher priced than the explosive or corrosible release devices.

One embodiment of the present invention provides an inexpensive reliable remotely actuated release device for tethering equipment packages to the bottom of bodies of water. The device is operable in water depths in excess of 20,000 feet and its reliability is not affected by high salinity of the water. These requirements could only be met by the most expensive of the existing prior art devices. In addition, the present invention offers the same advantages of low cost and reliability when used in other decoupling applications.

SUMMARY OF THE INVENTION

This invention provides a simple reliable release device which can be used to remotely decouple two coupled units. The device comprises a thermally fusible link which couples the two units. A heating element contacts the link in such a way as to melt through the link upon heating. Electric current is supplied to the heating element by a remotely activated means. Upon receiving the command signal, electric current is applied to the heating element which is in contact with the connective link. The heating element rapidly and reliably melts through the connective link which is formed of a thermally fusible material.

In underwater applications the area of the connective link where the melting and separation takes place is insulated from the surrounding water by forming a barrier within the link and on the surface of the connective link and by wrapping the same area with a water impermeable sheath. Also, for under water applications, the heating element is embedded within the link. By embedding the heating element within the connective link and insulating the area of the heating element the surrounding water is prevented from forming a heat sink which would prevent attainment of the necessary temperature for melting the link.

BRIEF DESCRIPTION OF THE DRAWINGS

FIG. 1 schematically shows an instrument package tethered to the ocean floor through a connective link incorporating a thermal release device.

FIG. 2 is a block diagram of an acoustic release circuit approach.

FIG. 3 shows the thermal release device area of the connective link.

FIG. 4 is a cross-section of the connective link showing the heating element.

DETAILED DESCRIPTION OF A SPECIFIC EMBODIMENT

Introduction

In FIG. 1, a bouyant instrumentation package (1) is tethered to an anchor (2) resting on the floor of the body of water by means of a connective link (3). The thermal release device (4) is located in the connective link (3) between the tether base (2) and the instrument package (1). The thermal release device (4) is connected to the acoustic release circuit (5) which decodes the command signal and activates the thermal release device.

A typical circuit for use in an undersea application is shown in FIG. 2. The acoustic signal from the recovery ship is received by the hydrophone (11). The electric signal then passes through a notch filter (13) and an automatic gain control (15). The frequency shift keyed demodulator (FSK) tracks the coded frequencies of the signal by means of a low power integrated circuit which uses a phase lock loop detection system. The output of the FSK demodulator is a digital bit stream representing the input frequency shifts. The output of the FSK demodulator goes to a decoding logic module (19). The current from the battery (21) is converted to alternating current by the dc to ac inverter (23) which supplies ac current to the release device.

Thermal Release Device

The connective link is made up of a thermally fusible material. Included among the suitable thermally fusible materials are polyamides, polyesters, polyolefins, polyvinyl materials, and polyacrylates. Selection of the material depends on the tensile strength required to couple the units, the flexibility of the link required for the particular application, and a consideration of the melting temperature to be used.

In underwater applications the preferred material is a rope made of thermoplastic material. Though not limited thereto the ropes used have been of the braid-on-braid construction which was selected for its round cross-section. Nylon and Dacron are the preferred rope materials with nylon 66 being the most preferred.

The heating element (8) is embedded through a cross-section of the connective link. When a rope connective link is used the heating element may be woven or otherwise embedded through a cross section of the link as shown in FIG. 3. The heating element may be a grid in a single plane as shown in FIG. 3 or the heating element may be made up of two or more grids in parallel planes. In one such embodiment the heating element consists of two grids in parallel planes 0.5 mm apart. The grids are oriented within their respective planes such that the wires of one grid run at right angles to the wires of the other grid. Use of two grids oriented in this manner provides more reliable parting as a large number of grid segments contact the connective link within a small cross section. In environments such as a gas or a vacuum in which heat transfer does not present a problem, the heating element need not be embedded within the connective link. For example, on a small diameter link, the element could simply encircle the link. In another embodiment, the heating element could take the form of a clip contacting the link on two sides. The clip would close as heat was applied and the link melted through.

The heating element is made of a high resistance wire such as Nichrome. In undersea applications the more preferred material for the heating element is Nichrome V wire which is corrosion resistant in sea water. Applications in other corrosive fluids will require selection of a material with corrosion resistance in that environment. The gauge of the resistance wire is selected for high resistance and the ability to achieve a high count weave. Forty gauge Nichrome V wire has been found to yield the desired properties of high resistance, ability to achieve a high count weave, and corrosion resistance in sea water. When current is passed through the heating element, the element heats and melts the rope fibers in the immediate vicinity and because of the close weave of the element the entire cross-section of the connective link is thus melted and parted. The tension supplied by the buoyant instrument package insures that the connective link will part after melting.

When the thermal release device is operated under water, the surrounding water must be prevented from forming a heat sink or the temperature will not rise to the approximately 400°–500° F. needed to sever the thermally fusible material of the connective link. To prevent excessive heat loss to the surrounding water a thermal barrier is created by impregnating the connective link above and below the heating element with a sealant to form a sealant impregnated zone (9). The zone, while not watertight, restricts the rate of exchange of hot water for cold in the vicinity of the heating element so that an excessive amount of energy is not required to achieve the necessary temperature. The exposed portion of the heating element is also thinly coated with the same sealant. The thermal barrier is then completed by wrapping the same area with a water impermeable sheath (10). The preferred sealant is a low viscosity room temperature vulcanizing silicone compound such as Dow Corning 734. The preferred sheath material is pressure sensitive polytetrafluoroethylene adhesive tape. Teflon is chosen as the material for the sheath to prevent the hot heating element from burning through and breaking upon coming in contact with cold water. The sheath is formed from two pieces of tape which are overlapped minimally in the grid area to ensure that the tape will not prevent the link from separating after melting.

One skilled in the art will appreciate that if the device is employed in an environment, such as air or a vacuum, that does not readily conduct heat away from the area of the heating element, no thermal barrier is required.

The preferred power source provides an alternating current. Direct current leakage to the water was found to corrode the anode end of the heating element through in seconds and current leakage also reduced the heat produced near the cathode end of the heating element. Direct current may be used in non-conductive environments.

Current and voltage requirements are dependent upon the nature of the heating element, the melting temperature of the material of the connective link, the thermal conductivity of the link environment, and the integrity of the thermal barrier. Voltage ranging from 12 to 60 volts and currents from 1 to 3 amperes have been employed successfully.

In a typical underwater operation, an instrument package is tethered to the floor of a body of water through the connective link. After the desired period of data gathering, a recovery ship transmits a coded acoustical signal which is received by the hydrophone. Upon receipt of the proper code, electric current is supplied to the heating element which melts the adjacent fibers causing the link to sever.

Further modifications and alternate embodiments of the invention will be apparent to those skilled in the art in view of this description. Accordingly, this description is to be considered as illustrative only and for the purpose of teaching those skilled in the art the manner of carrying out the invention. Various changes may be made in the shape, size, and arrangement of parts. It is intended that all such alternatives, modifications, and variations which fall within the spirit and scope of the invention as defined in the appended claims be embraced thereby.

What is claimed is:

1. A remotely actuated device for releasing a buoyant object connected to an anchor on the floor of a body of water which comprises:
   - a thermoplastic fiber rope connective link between the buoyant object and the anchor;
   - a high resistance wire heating element embedded across a cross-section of said rope;
   - a thermal barrier to prevent heat loss from said heating element to the surrounding water, said barrier comprising
     - a sealant impregnated zone in said rope above and below said heating element and a sheath encircling said connective link in the area of said heating element, said sheath being readily partable in the vicinity of the heating element upon melting of the link;
     - remotely activated means to supply an alternating electric current to said wire to melt said rope.

2. The device of claim 1, wherein said sealant is a silicone compound.

3. The device of claim 1, wherein said sheath is a polytetrafluoroethulene wrapping.

4. The device of claim 1, wherein said rope is nylon.

5. A remotely actuated device for releasing a bouyant object connected to an anchor on the floor of a body of water which comprises:
   - a thermoplastic fiber rope connective link between the bouyant object and the anchor;

a heating element in contact with said link;

a thermal barrier to prevent heat loss from said heating element to the surrounding water, said barrier comprising a sealant impregnated zone in said rope above and below said heating element and a sheath encircling said connective link in the area of said heating element, said sheath being readily partable in the vicinity of the heating element upon melting of the link;

remotely actuated means to supply an electric current to said heating element to melt said link.

6. The device of claim 5, wherein said heating element is a high resistance wire embedded across a cross section of said connective link.

7. The device of claim 5 wherein said sealant is a silicone compound.

8. The device of claim 5, wherein said sheath is a polytetrafluoroethylene wrapping.

9. The device of claim 5 wherein said thermo plastic rope is nylon.

* * * * *